US007166789B2

(12) United States Patent
Warden

(10) Patent No.: US 7,166,789 B2
(45) Date of Patent: Jan. 23, 2007

(54) DEVICE FOR PREVENTING UNINTENTIONAL REMOVAL OF AN END OF A GUITAR STRAP FROM AN ENLARGED GUITAR STRAP PEG OF A GUITAR

(76) Inventor: Bruce L. Warden, 2512 Brendenwood Rd., Rockford, IL (US) 61107

( * ) Notice: Subject to any disclaimer, the term of this patent is extended or adjusted under 35 U.S.C. 154(b) by 1323 days.

(21) Appl. No.: 09/777,299

(22) Filed: Feb. 6, 2001

(65) Prior Publication Data

US 2002/0104425 A1 Aug. 8, 2002

(51) Int. Cl.
*G10G 5/00* (2006.01)

(52) U.S. Cl. ..... 84/327; 84/453; 84/329; 84/322

(58) Field of Classification Search ..... 84/327, 84/453, 421, 329, 322
See application file for complete search history.

(56) References Cited

U.S. PATENT DOCUMENTS

| | | | | |
|---|---|---|---|---|
| 3,894,464 A | | 7/1975 | Brooks | 84/327 |
| 4,188,851 A | * | 2/1980 | Wolf | 84/327 |
| 4,271,999 A | | 6/1981 | Stravitz | 224/257 |
| D293,687 S | | 1/1988 | Nichols | D17/20 |
| 4,993,127 A | | 2/1991 | Mechem et al. | 24/701 |
| 5,868,293 A | | 2/1999 | D'Addario et al. | 224/257 |
| 5,880,384 A | | 3/1999 | Beck | 84/327 |
| 6,191,347 B1 | * | 2/2001 | Hoshino | 84/327 |

OTHER PUBLICATIONS

Internet: http://www.streetlock.com (3 pages).

* cited by examiner

*Primary Examiner*—Shih-Yung Hsieh
(74) *Attorney, Agent, or Firm*—Richard L. Miller

(57) ABSTRACT

A device for preventing unintentional removal of a guitar strap from a guitar strap peg. The device includes a body for positioning on the guitar strap peg, outboard of the guitar strap. The body is disk-shaped and has a periphery, a throughbore extending centrally therethrough, and a throughslot communicating with the throughbore therein and the periphery thereof, and is for allowing the neck of the guitar strap peg to slide therein, and into the throughbore, and when therein, one surface of the body is wedged against the head of the guitar strap peg, and an opposing surface of the body wedges the guitar strap against the guitar, and when doing so, prevents the slot in the guitar strap from escaping past the head of the guitar strap peg, and in doing so, prevents the guitar strap from being unintentionally removed from the guitar strap peg.

8 Claims, 1 Drawing Sheet

DEVICE FOR PREVENTING UNINTENTIONAL REMOVAL OF AN END OF A GUITAR STRAP FROM AN ENLARGED GUITAR STRAP PEG OF A GUITAR

BACKGROUND OF THE INVENTION

1. Field of the Invention

The present invention relates to a guitar. More particularly, the present invention relates to a device for preventing unintentional removal of a slot in an end of a guitar strap from an engaged guitar strap peg of a guitar.

2. Description of the Prior Art

Numerous innovations for guitar strap related devices have been provided in the prior art that will be described. Even though these innovations may be suitable for the specific individual purposes to which they address, however, they differ from the present invention.

A FIRST EXAMPLE, U.S. Pat. No. Des. 293,687 to Nichols teaches the ornamental design for a retaining button for a guitar strap.

A SECOND EXAMPLE, U.S. Pat. No. 3,894,464 to Brooks teaches an improved musical instrument strap attaching, holding, and supporting device and method for supporting, for example, guitars by slitted straps utilizing uniquely shaped and designed retaining devices. The novel attaching, holding and supporting device is usually located at the bottom end of the guitar body for all types of guitars and also near the neck of the guitar for electric guitars. The device includes an attachment wedge, usually a screw for electric guitars or wooden wedge for either "F hole" or folk or classic guitars, and a central stem portion which is cylindrical in shape which mates with the attachment wedge on one end and a strap retaining head on the other end. The strap retaining head is elongated at one end, forming a generally isosceles triangular shape with curved corners, similar to that of a plectrum, and has a hemispherical projection on its inner side facing the guitar body the combination being used to support the body of the guitar by a shoulder strap or sling placed between the guitar body and the strap retainer and connected by friction and weight to the shoulder of the person playing the guitar and, in the case of "F Hole" or folk or classic guitars, to the neck of the guitar by other means such as a string. The elongated tip of the retaining head is initially inserted into the slit of the strap in a lateral direction and then rotated 90 degrees. The longest dimension of the retainer head is preferably greater than the length of the slit, and the distance between the tip of the hemispherical projection and the bottom of the central stem is preferably less than the thickness of the strap.

A THIRD EXAMPLE, U.S. Pat. No. 4,271,999 to Stravitz teaches a guitar strap connector that comprises a body member having a slot for connection of a guitar strap thereto; a generally keyhole-shaped opening in the body member, the keyhole-shaped opening comprising first and second holes having a passageway therebetween, the first hole being larger than the second hole; and a pair of resilient spring-like members integral with the body member and adjacent at least the passageway on respective opposite sides of the passageway, the spring-like members being bowed toward each other and each having a respective void space therebehind to permit the spring-like members to flex away from each other into the void spaces to permit a button connector of a guitar to be passed from the larger hole resiliently through the passageway and into the smaller hole wherein the button connector is engaged. Preferably, the body member is integrally formed of resilient plastic material such as polypropylene.

A FOURTH EXAMPLE, U.S. Pat. No. 4,993,127 to Mechem et al. teaches a device for locking a guitar strap to a guitar that has a slotted base with one slot for receiving a guitar strap through it, and a second slot for mounting to the strap peg on the guitar. The second slot is keyhole shaped and has an entry portion and a retaining portion, the entry portion being large enough to receive the head of the peg, and the retaining portion being narrow enough to prevent the peg head from passing through it. A slot blocking lid is hinged to the base and pivotable about the hinge to close so that the entry portion of the slot can be blocked when the peg has been received in the retaining portion of the slot. A retainer strap is secured to the base at one end remote from the hinge, and extends through a slot in the lid, also remote from the hinge, and fastened by a snap fastener adjacent the hinge to hold the slot blocker lid in locking position until the retainer strap is intentionally released. The arrangement of the retainer strap is such that it has a very large mechanical advantage impeding the inadvertent release thereof.

A FIFTH EXAMPLE, U.S. Pat. No. 5,868,293 to D'Addario et al. teaches a quick release musical instrument strap attachment device comprising a strap attachment unit which comprises a female receiving quick release portion having base portion and a hollow body portion for receiving and locking a male quick release portion and a first cord having both ends thereof attached to the base portion of the female quick release portion to form a loop and a musical instrument attachment unit comprising a male quick release insertion unit which comprises a base portion and an insertion means adapted for insertion and locking into the hollow body portion of the female receiving quick release portion and a second cord having both ends thereof attached to the base portion of the male receiving quick release portion to form a loop. The strap attachment unit being attachable to a strap and the musical instrument attachment unit being attachable to a musical instrument.

A SIXTH EXAMPLE, U.S. Pat. No. 5,880,384 to Beck teaches a shoulder strap of an acoustic guitar or similar stringed instrument that is attached to the neck of the instrument through an attachment device including a looped portion which extends beneath the strings along one side of the neck, and across the bottom of the neck, and along the opposite side of the neck to be joined to the end portion adjacent the top edge of the neck. The fastener joins the end portions together, and is provided with a stem and a head over which the slotted end of the guitar strap may be manipulated to rest on the stem and be retained on the fastener by the head.

It is apparent that numerous innovations for guitar strap related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a device for preventing unintentional removal of a slot in an end of a guitar strap from an engaged guitar strap peg of a guitar that avoids the disadvantages of the prior art.

ANOTHER OBJECT of the present invention is to provide a device for preventing unintentional removal of a slot in an end of a guitar strap from an engaged guitar strap peg of a guitar that is simple and inexpensive to manufacture.

STILL ANOTHER OBJECT of the present invention is to provide a device for preventing unintentional removal of a slot in an end of a guitar strap from an engaged guitar strap peg of a guitar that is simple to use.

BRIEFLY STATED, STILL YET ANOTHER OBJECT of the present invention is to provide a device for preventing unintentional removal of a guitar strap from a guitar strap peg. The device includes a body for positioning on the guitar strap peg, outboard of the guitar strap. The body is disk-shaped and has a periphery, a throughbore extending centrally therethrough, and a throughslot communicating with the throughbore therein and the periphery thereof, and is for allowing the neck of the guitar strap peg to slide therein, and into the throughbore, and when therein, one surface of the body is wedged against the head of the guitar strap peg, and an opposing surface of the body wedges the guitar strap against the guitar, and when doing so, prevents the slot in the guitar strap from escaping past the head of the guitar strap peg, and in doing so, prevents the guitar strap from being unintentionally removed from the guitar strap peg.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

First Embodiment

Figure 1:
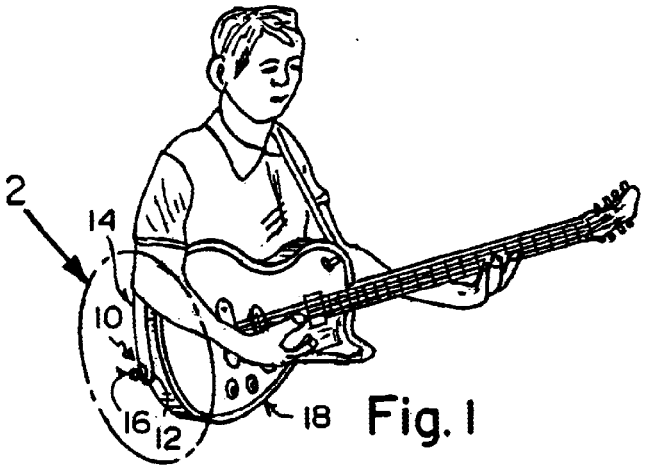
FIG. 1 is a diagrammatic perspective view of the present invention in use.

10 device of present invention for preventing unintentional removal of slot 11 in end 12 of guitar strap 14 from engaged guitar strap peg 16 of guitar 18
11 slot in end 12 of guitar strap 14 of guitar 18
12 end of guitar strap 14 of guitar 18
14 guitar strap of guitar 18
16 engaged guitar strap peg 16 of guitar 18
18 guitar
20 neck of engaged guitar strap peg 16 of guitar 18
22 end of neck 20 of engaged guitar strap peg 16 of guitar 18
24 head of engaged guitar strap peg 16 of guitar 18
26 body for positioning on guitar strap peg 16 of guitar 18, outboard of guitar strap 14 of guitar 18
28 center of body 26
30 periphery of body 26
32 first surface of body 26 for abutting against head 24 of engaged guitar strap peg 16 of guitar 18
34 second surface of body 26 for abutting against, and overpassing, slot 11 in end 12 of guitar strap 14 of guitar 18
36 throughbore through body 26 for receiving neck 20 of engaged guitar strap peg 16 of guitar 18
38 perimeter of throughbore 36 through body 26
40 chord of throughbore 36 through body 26
42 ends of chord 40 of throughbore 36 through body 26
44 throughslot through body 26 for allowing neck 20 of engaged guitar strap peg 16 of guitar 18 to slide therein, and into throughbore 36 in body 26
46 pair of edges defining throughslot 44 through body 26

Second Embodiment

110 device of present invention for preventing unintentional removal of slot 11 in end 12 of guitar strap 14 from engaged guitar strap peg 16 of guitar 18
126 body
128 throughbore through body 126
130 periphery of body 126
140 chord of throughbore 128 through body 126
142 ends of chord 140 of throughbore 128 through body 126
144 throughslot through body 126
146 pair of edges 146 defining throughslot 144 through body 126

DETAILED DESCRIPTION OF THE PREFERRED EMBODIMENT

Figure 2:
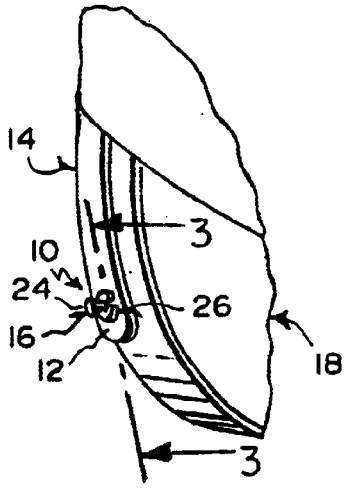
FIG. 2 is an enlarged diagrammatic perspective view of the area generally enclosed by the dotted curve identified by arrow 2 in FIG. 1.

Referring now to the figures, in which like numerals indicate like parts, and particularly to FIGS. 1 and 2, the device of the present invention is shown generally at 10 for preventing unintentional removal of a slot 11 in an end 12 of a guitar strap 14 from an engaged guitar strap peg 16 of a guitar 18.

The engaged guitar strap peg 16 of the guitar 18 has a neck 20 that extends from the guitar 14, to an end 22, and has a contour and a thickness.

The engaged guitar strap peg 16 of the guitar 18 further has a head 24 that extends radially outwardly from the end 22 of the neck 20 thereof.

Figure 3:
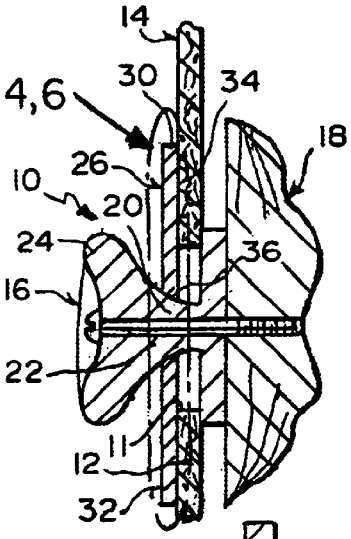
FIG. 3 is an enlarged diagrammatic cross sectional view taken on line 3—3 in FIG. 2.
Figure 4:
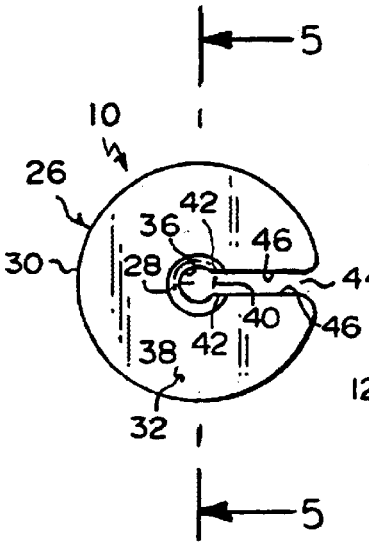
FIG. 4 is a diagrammatic plan view of the area generally enclosed by the dotted curve identified by arrow 4 in FIG. 3 of a first embodiment of the present invention.
Figure 5:
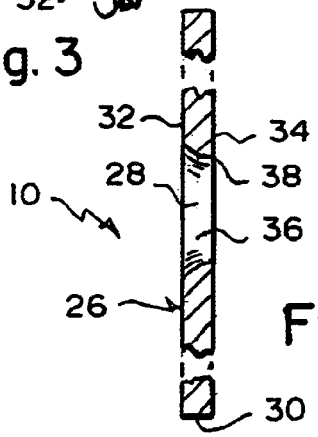
FIG. 5 is an enlarged diagrammatic cross sectional view taken on line 5—5 in FIG. 4.

The configuration of a first embodiment of the device 10 can best be seen in FIGS. 3–5, and as such, will be discussed with reference thereto.

The device 10 comprises a body 26 for positioning on the guitar strap peg 16 of the guitar 18, outboard of the guitar strap 14 of the guitar 18 and for preventing unintentional removal of the slot 11 in the end 12 of the guitar strap from the engaged guitar strap peg of the guitar.

The body 26 is disk-shaped.

The body 26 has a center 28, a periphery 30, a first surface 32 that is circular-shaped and is for abutting against the head 24 of the engaged guitar strap peg 16 of the guitar 18, and a second surface 34 that is circular-shaped, disposed oppositely to the first surface 32 thereof, and is for abutting against, and overpassing, the slot 11 in the end 12 of the guitar strap 14 of the guitar 18.

The body 26 further has a throughbore 36 that is circular-shaped, has a diameter, a perimeter 38, and a chord 40 with a length and ends 42 that intersect the perimeter 38 of the throughbore 36 in the body 26.

The diameter of the throughbore 36 in the body 26 is for being slightly greater than the thickness of the engaged guitar strap peg 16 of the guitar 18.

The length of the chord of the throughbore 36 in the body 16 relative to the thickness of the engaged guitar strap peg 16 of the guitar 18 is such so as to allow the engaged guitar strap peg 16 of the guitar 18 to slide snugly therepast.

The throughbore 36 in the body 26 extends through the center 28 thereof, from the first surface 32 thereof, to the second surface 34 thereof, and is for receiving the neck 20 of the engaged guitar strap peg 16 of the guitar 18.

The body 26 further has a throughslot 44 that communicates with the throughbore 36 therein and the periphery 30 thereof, and is for allowing the neck 20 of the engaged guitar strap peg 16 of the guitar 18 to slide therein, and into the throughbore 36 in the body 26, and when in the throughbore 36 in the body 26, the first surface 32 of the body 26 is wedged against the head 24 of the engaged guitar strap peg 16 of the guitar 18, and the second surface 34 of the body 26 wedges the guitar strap 14 of the guitar 18 against the guitar 18, and when doing so, prevents the slot 11 in the end 12 of the guitar strap 14 of the guitar 18 from escaping past the head 24 of the engaged guitar strap peg 16 of the guitar 18, and in doing so, prevents the guitar strap 14 of the guitar 18 from being unintentionally removed from the engaged guitar strap peg 16 of the guitar 18.

The throughslot 44 in the body 26 is defined by a pair of edges 46 that equidistantly straddle a radius of the body 26, are straight, oppose each other, and extend radially outwardly from the pair of ends of the chord 40 of the throughbore 28 in the body 26, respectively, to the periphery 30 of the body 26, where they are rounded for facilitating original engagement with the engaged guitar strap peg 16 of the guitar 18 and for eliminating guitar strap peg damaging sharp points.

The perimeter 38 of the throughbore 28 in the body 26 is slightly beveled completely therearound, on the first surface 32 of the body 26, for conforming to the contour of the neck 20 of the engaged guitar strap peg 16 of the guitar 18 so as to provide a snugger fit and for eliminating a guitar strap peg damaging sharp edge.

The throughslot 44 in the body 26 is rectangular-shaped, and the pair of edges 46 thereof are parallel to each other and spaced-apart form each other a distance for allowing the engaged guitar strap peg 16 of the guitar 18 to slide snugly therebetween, and as a result thereof, allows the device 10 to engage the engaged guitar strap peg 16 of the guitar 18 when the engaged guitar strap peg 16 of the guitar 18 is not in the throughbore 28 in the body 26 so as to prevent the device 10 from jumping off the engaged guitar strap peg 16 of the guitar 18.

Figure 6:
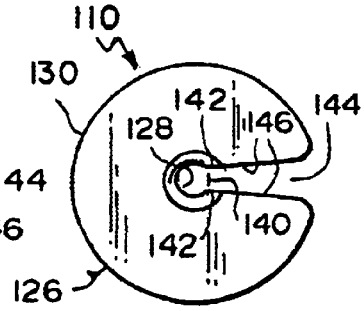
FIG. 6 is a diagrammatic plan view of the area generally enclosed by the dotted curve identified by arrow 6 in FIG. 3 of a second embodiment of the present invention.

A second embodiment of the device 110 can best be seen in FIG. 6, and as a result thereof, will be discussed with reference thereto.

The device 110 is similar to the device 10, except that:

1. The throughslot 144 in the body 126 is isosceles-triangular-shaped.
2. The pair of edges 146 of the throughslot 144 in the body 126 divergingly straddle the radius of the body 126, and extend radially outwardly from the ends 142 of the chord 140 of the throughbore 128 in the body 126, respectively, divergingly to the periphery 130 of the body 126 for facilitating engagement of the throughslot 144 in the body 126 with the engaged guitar strap peg 16 of the guitar 18.

It will be understood that each of the elements described above, or two or more together, may also find a useful application in other types of constructions differing from the types described above.

While the invention has been illustrated and described as embodied in a device for preventing unintentional removal of a slotted end of a guitar strap from an engaged guitar strap peg of a guitar, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for preventing unintentional removal of a slot in an end of a guitar strap from an engaged guitar strap peg of a guitar, wherein the engaged guitar strap peg of the guitar has a neck that extends from the guitar, to an end, and has a contour and a thickness, and wherein the engaged guitar strap peg of the guitar further has a head that extends radially outwardly from the end of the neck thereof, said device comprising a body for positioning on the guitar strap peg of the guitar, outboard of the guitar strap of said guitar, and for preventing unintentional removal of the slot in the end of the guitar strap from the engaged guitar strap peg of the guitar, wherein said body is disk-shaped, wherein said body has:

a) a center;

b) a periphery;

c) a first surface that is circular-shaped and is for abutting against the head of the engaged guitar strap peg of the guitar; and d) a second surface that is circular-shaped, disposed oppositely to said first surface thereof, and is for abutting against, and overpassing, the slot in the end of the guitar strap of the guitar, wherein said body further has a throughbore that is circular-shaped, has a diameter, a perimeter, and a chord with a length and ends that intersect said perimeter of said throughbore in said body.

2. The device as defined in claim 1, wherein said diameter of said throughbore in said body is for being slightly greater than the thickness of the engaged guitar strap peg of the guitar.

3. The device as defined in claim 1, wherein said length of said chord of said throughbore in said body relative to the thickness of the engaged guitar strap peg of the guitar is such so as to allow the engaged guitar strap peg of the guitar to slide snugly therepast.

4. The device as defined in claim 1, wherein said throughbore in said body extends through said center thereof, from said first surface thereof, to said second surface thereof, and is for receiving the neck of the engaged guitar strap peg of the guitar.

5. The device as defined in claim 1, wherein said body further has a throughslot that communicates with said throughbore therein and said periphery thereof, and is for allowing the neck of the engaged guitar strap peg of the guitar to slide therein, and into said throughbore in said body, and when in said throughbore in said body, said first surface of said body is wedged against the head of the engaged guitar strap peg of the guitar, and said second surface of said body wedges the guitar strap of the guitar against the guitar, and when doing so, prevents the slot in the end of the guitar strap of the guitar from escaping past the head of the engaged guitar strap peg of the guitar, and in doing so, prevents the guitar strap of the guitar from being unintentionally removed from the engaged guitar strap peg of the guitar.

6. The device as defined in claim 5, wherein said throughslot in said body is defined by a pair of edges that equidistantly straddle a radius of said body, are straight, oppose each other, and extend radially outwardly from said pair of ends of said chord of said throughbore in said body, respectively, to said periphery of said body, where they are rounded for facilitating original engagement with the engaged guitar strap peg of the guitar and for eliminating guitar strap peg damaging sharp points.

7. The device as defined in claim 6, wherein said throughslot in said body is rectangular-shaped, and said pair of edges thereof are parallel to each other and spaced-apart form each other a distance for allowing the engaged guitar strap peg of the guitar to slide snugly therebetween, and as a result thereof, allows said device to engage the engaged guitar strap peg of the guitar when the engaged guitar strap peg of the guitar is not in said throughbore in said body so as to prevent said device from jumping off the engaged guitar strap peg of the guitar.

8. The device as defined in claim 6, wherein said pair of edges of said throughslot in said body divergingly straddle said radius of said body, and extend radially outwardly from said ends of said chord of said throughbore in said body, respectively, divergingly to said periphery of said body for facilitating engagement of said throughslot in said body with the engaged guitar strap peg of the guitar.

* * * * *